US007712171B2

(12) United States Patent
Butler

(10) Patent No.: US 7,712,171 B2
(45) Date of Patent: May 11, 2010

(54) PATIENT SUPPORT INCLUDING TURN ASSIST, LOW AIR LOSS, OR INTEGRATED LATERAL TRANSFER

(75) Inventor: Mary Butler, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 12/041,075

(22) Filed: Mar. 3, 2008

(65) Prior Publication Data

US 2008/0263763 A1 Oct. 30, 2008

Related U.S. Application Data

(60) Provisional application No. 60/913,906, filed on Apr. 25, 2007.

(51) Int. Cl.
*A61G 7/10* (2006.01)

(52) U.S. Cl. ..... 5/715; 5/81.1 R; 5/722

(58) Field of Classification Search ..... 5/715, 5/722, 655.3, 657, 640, 644, 81.1 R
See application file for complete search history.

(56) References Cited

U.S. PATENT DOCUMENTS 4,745,647 A 5/1988 Goodwin
4,807,313 A * 2/1989 Ryder et al. ..... 5/610
4,962,552 A 10/1990 Hasty
5,103,519 A 4/1992 Hasty
5,138,729 A 8/1992 Ferrand
5,181,288 A 1/1993 Heaton et al.
5,323,500 A 6/1994 Roe et al.
5,345,629 A 9/1994 Ferrand
5,526,543 A 6/1996 DiMatteo
5,781,949 A 7/1998 Weismiller et al.
5,802,646 A 9/1998 Stolpmann et al.
5,815,865 A 10/1998 Washburn et al.
5,934,280 A 8/1999 Viard et al.
5,944,066 A 8/1999 Viard
5,966,763 A 10/1999 Thomas et al.
6,212,718 B1 4/2001 Stolpmann et al.
6,243,894 B1 6/2001 Kosumsuppamala et al.
6,568,013 B2 5/2003 Perez et al.
6,584,628 B1 7/2003 Kummer et al.
6,622,324 B2 9/2003 VanSteenburg et al.
6,701,558 B2 3/2004 VanSteenburg
6,735,500 B2 5/2004 Nicholas et al.
6,839,929 B2 1/2005 Stolpmann
6,855,158 B2 2/2005 Stolpmann
6,892,405 B1 5/2005 Dimitriu et al.
6,904,631 B2 6/2005 Vrzalik et al.
7,007,330 B2 3/2006 Kuiper et al.

(Continued)

FOREIGN PATENT DOCUMENTS

WO 2004/089270 A1 10/2004

OTHER PUBLICATIONS

European Search Report dated Jun. 17, 2009 from related EP 08 25 1067 (5 pages).

*Primary Examiner*—Fredrick Conley
(74) *Attorney, Agent, or Firm*—Barnes & Thornburg LLP

(57) ABSTRACT

A patient support including turn assist, low air loss or integrated lateral transfer. The patient support is adapted to support a bariatric patient and includes a turning bladder for turning or assisting in turning a bariatric patient.

16 Claims, 8 Drawing Sheets

U.S. PATENT DOCUMENTS

| | | | |
|---|---|---|---|
| 7,296,312 | B2 | 11/2007 | Menkedick et al. |
| 7,308,725 | B2 | 12/2007 | Cazzini et al. |
| 7,346,945 | B2 | 3/2008 | Phillips et al. |
| 2006/0112489 | A1 | 6/2006 | Bobey et al. |
| 2007/0143928 | A1 | 6/2007 | Biggie et al. |
| 2007/0163052 | A1 | 7/2007 | Romano et al. |
| 2008/0028533 | A1 | 2/2008 | Stacy et al. |
| 2008/0040860 | A1 | 2/2008 | Price et al. |

* cited by examiner

PATIENT SUPPORT INCLUDING TURN ASSIST, LOW AIR LOSS, OR INTEGRATED LATERAL TRANSFER

CROSS-REFERENCE TO RELATED APPLICATION

This application claims the benefit of Butler, U.S. Provisional Patent Application Ser. No. 60/913,906, entitled "Patient Support Including Turn Assist, Low Air Loss, or Integrated Lateral Transfer," filed Apr. 25, 2007, which is incorporated herein by this reference.

BACKGROUND

Patient Supports, including those used in hospitals, long term care facilities, and for home are used to support a patient and can include the support of a bariatric patient. Bariatric beds are designed for use by obese, heavy, or large patients. Bariatric beds typically include a larger than average heavy duty frame to support the patient size and weight. Such bariatric beds can be configured to support patients up to 1,000 lbs. or more.

During a patient's stay at a hospital or other healthcare facility including a home environment, patients on occasion may be turned on one of their sides by a caregiver to provide for care of the patient. For instance, it is common to place a patient on one or the other side to reduce or to eliminate the occurrence of pressure ulcers. In addition, a patient can be placed on a side to provide for bathing as well as to provide for changing the linens used on a patient support surface or mattress. In addition, turning of a patient can be helpful when a caregiver provides assistance to a patient when changing clothing.

SUMMARY OF THE INVENTION

The present invention may comprise one or more of the features recited in the appended claims and/or one or more of the following features or combinations thereof. The present disclosure relates to a bariatric patient support to support a bariatric patient. The patient support/bed of the present disclosure is configured to support patients up to 1,000 lbs., preferably patients between 250 lbs. and 1,000 lbs., although it is within the scope of the present invention to accommodate patients of lesser as well as greater weights. The patient support includes a frame adapted to support the bariatric patient, a deck coupled to the frame which includes a plurality of moving sections each of which is adapted to support a portion of the bariatric patient, and a mattress supported by the deck. A bladder to turn the bariatric patient is supported by the mattress. The bladder includes a unitary structure and includes a base portion, a first side portion coupled to the base portion and a second side portion coupled to the base portion. A first fastener is coupled to the first side portion and includes a closed position and an open position. The closed position holds the first side portion in a closed condition and the open position releases the first side portion to an open condition having a first height.

According to another aspect of the present disclosure, there is provided a turning bladder to turn a bariatric patient including a base portion, a first side portion coupled to the base portion, a second side portion coupled to the base portion, and a first fastener. The first fastener is coupled to the first side portion and includes a closed position and an open position. The closed position holds the first side portion in a closed condition and the open position releases the first side portion to an open condition having a first height.

In still another aspect of the present invention, there is provided a patient support to support a bariatric patient. The patient support includes a foam member, at least one air bladder supported by the foam member, a three dimensional fiber network supported by the at least one air bladder, and a turning bladder. The turning bladder is adapted to be inflated with a fluid and includes a base portion, a first side portion and a second side portion each coupled to a top portion and to the base portion. A restraint is coupled to the top portion and to the base portion and is disposed between the first side portion and the second side portion. The restraint includes a dimension to restrict a distance between the top portion and the bottom portion.

BRIEF DESCRIPTION OF THE DRAWINGS

The detailed description particularly refers to the accompanying figures in which.

DETAILED DESCRIPTION OF THE DRAWINGS

The embodiments described below and shown in the figures are merely exemplary and are not intended to limit the invention to the precise forms disclosed. Instead, the embodiments were selected for description to enable one of ordinary skill in the art to practice the invention.

Figure 1:
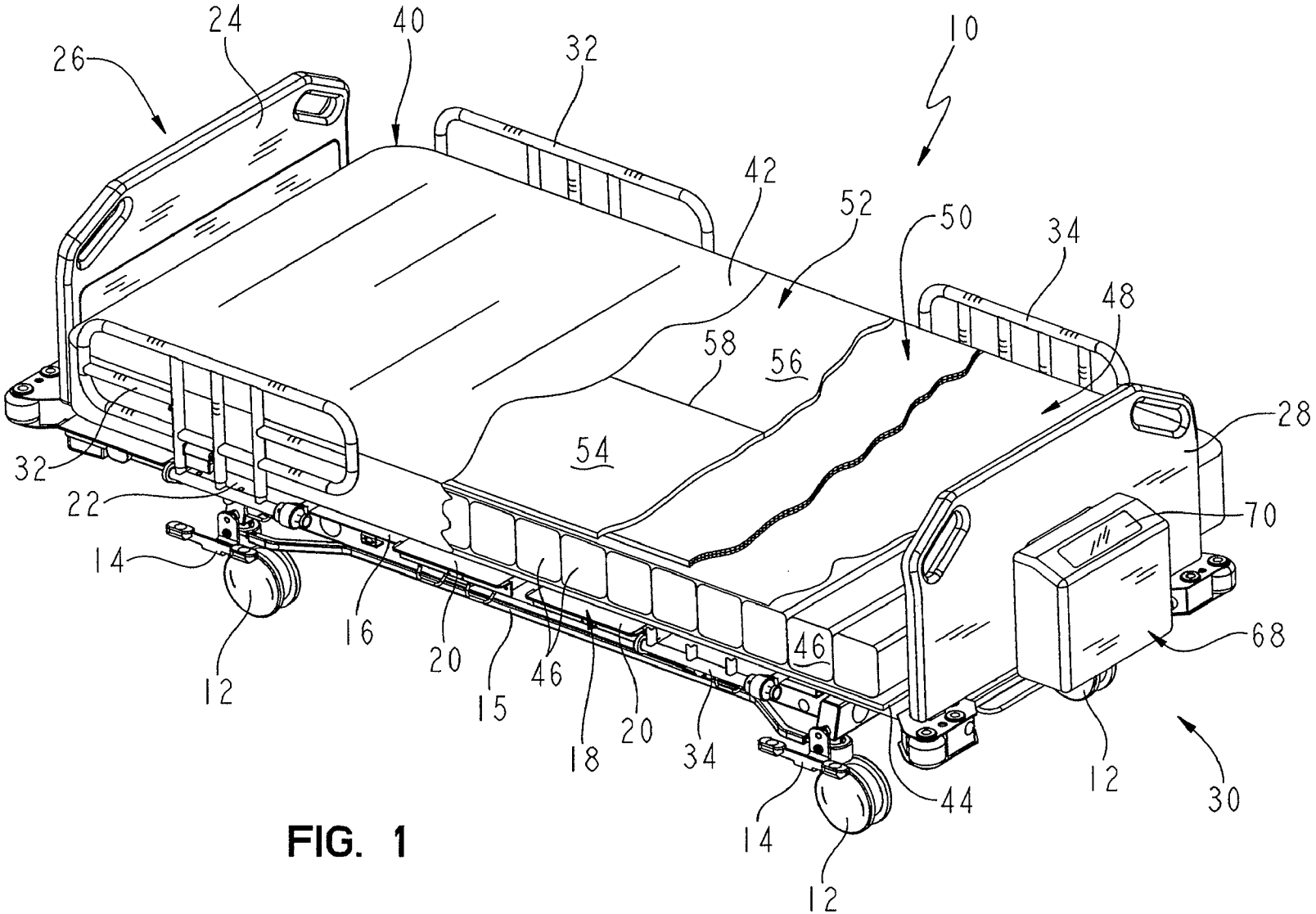
FIG. 1 illustrates a perspective view of one embodiment of a patient support.

Referring initially to FIG. 1, a patient support 10 is illustrated to include a base frame 11 supported by a plurality of casters 12 each of which can be locked into place by a brake/steer pedal 14. A connecting rod 15 couples break/steer pedal 14 through a linkage (not shown). An intermediate frame 16 is supported by the base frame 11 and is coupled to an articulating support deck 18. The support deck 18 includes a plurality of sections configured to articulate relative to one another including a head section, a seat section, and a foot section. In other embodiments, a foot section may be included intermediate the seat section and the foot section. In addition, support deck 18 can further include a deck extension assembly located adjacent the foot section. The deck extension assembly can be moved with respect to the foot section through the actuation of a release handle. Further details of the articulating deck and the deck extension assembly can be found in U.S. patent application Ser. No. 11/612,070, having a filing date of Dec. 18, 2006, the disclosure of which is expressly incorporated by reference herein.

The support deck 18 also includes sliding panels 20 and side rail sliding panels 22 which may be moved laterally to expand and to retract the width of the deck 18. Examples of expanding support decks are provided in U.S. patent application Ser. No. 11/191,651 filed Jul. 28, 2005 the disclosure of which is expressly incorporated by reference herein. The sliding panels 20 and side rail sliding panels 22 can be used to adjust the distance between opposed panels or opposed side rails to increase or decrease the distance therebetween. In one embodiment, the distance between opposed panels or side rails can be adjusted from approximately 40 inches to approximately 50 inches. The deck 18 provides for a variable distance between panels to provide for the use of an expandable width patient support surface. Such expandable width surfaces include expansion of either foam surfaces and/or by the use of air bolsters or foam bolsters. Example of expandable width support surfaces can be found in U.S. Pat. No. 7,111,348 entitled "Mattress Assembly" having an issue date of Sep. 26, 2006, the entirety of which is incorporated herein expressly by reference.

A head board 24 can be mounted to the intermediate frame 16 adjacent a head end 26 of patient support 10. A foot board 28 is mounted to the intermediate frame 16 adjacent a foot end 30 of patient support 10. The patient support 10 further includes a pair of head end side rail assemblies 32 and a pair of foot end side rail assemblies 34 coupled to the support deck 18 through the associated side rail sliding panels 22 located on opposite sides of the patient support 10. Only a portion of one of the foot and side rail assemblies 34 is illustrated.

Additional details of the side rails can be found in U.S. patent application Ser. No. 11/368,791 having a filing date of Mar. 6, 2006, the disclosure of which is expressly incorporated by reference herein.

The frame 18 supports a patient mattress, also known as a patient support surface 40, which supports a patient, and in particular a bariatric patient. The patient support surface 40 includes a number of features to accommodate bariatric patients but which can be used for all patients or persons of all types and sizes. The patient support surface includes a coverlet 42 to enclose and to protect the various components of the surface 40 enclosed therein. The coverlet 42 can be made of a water impermeable material which allows for water vapor transmission from inside the coverlet to the outside thereof but prevents moisture from entering from the outside of the coverlet 42 to the inside thereof. Various coverlets and the materials therefore are known to those skilled in the art.

The patient support surface 40 further includes a foam base or foam supporting layer 44 which is adjacent a bottom portion of the coverlet 42 which is supported by the deck 18. A plurality of bladders are located above the foam base 44 and are supported thereby. The plurality of bladders 46 can be filled with a fluid, typically air. The plurality of bladders 46 can either be individually inflated and controlled for providing a controllable mattress to accommodate the patient. The bladders can also be filled with foam or other known support material.

The air bladders 46 are enclosed in a polyurethane barrier 48, a portion of which is shown located adjacent to and above the bladders 46. The polyurethane barrier can be formed to completely enclose the exposed surfaces of the bladders 46 or can be a single layer of fabric or other material which is provided on a top surface only of the air bladders 46. The polyurethane barrier is substantially water and air impermeable and provides a barrier to substantially prevent moisture and/or other unwanted materials from contacting the air bladders 46.

A topper 50 is located adjacent to and above the polyurethane barrier. The topper 50 provides a low air loss feature of the present patient support surface 40. The low air loss topper can include a quilted material in which the material includes a compressible material such that air can be circulated within the topper 50. In addition, it is also possible for the topper 50 to include one or more layers of a three dimensional fiber material. For additional details of the three dimensional fiber material, please see U.S. patent application Ser. No. 10/793,723 having a filing date of Mar. 5, 2004, the entirety of which is expressly incorporated by reference herein.

A turning bladder 52 is located above and supported by the topper 50. The turning bladder 52 includes a first side 54 and a second side 56. The first side 54 and second side 56 extend the length of the support surface 40. A center line 58 extends longitudinally from the head end of the bladder 52 to the foot end of the bladder 52 between the first side 54 and second side 56. The first side 54 and the second side 56 can also be known respectively as the right side 54 and left side 56 corresponding to a patient laying on their back with their head located at the head end 26. Additional details of the bladder 52 are discussed with respect to FIG. 3 through FIG. 6.

Figure 2:
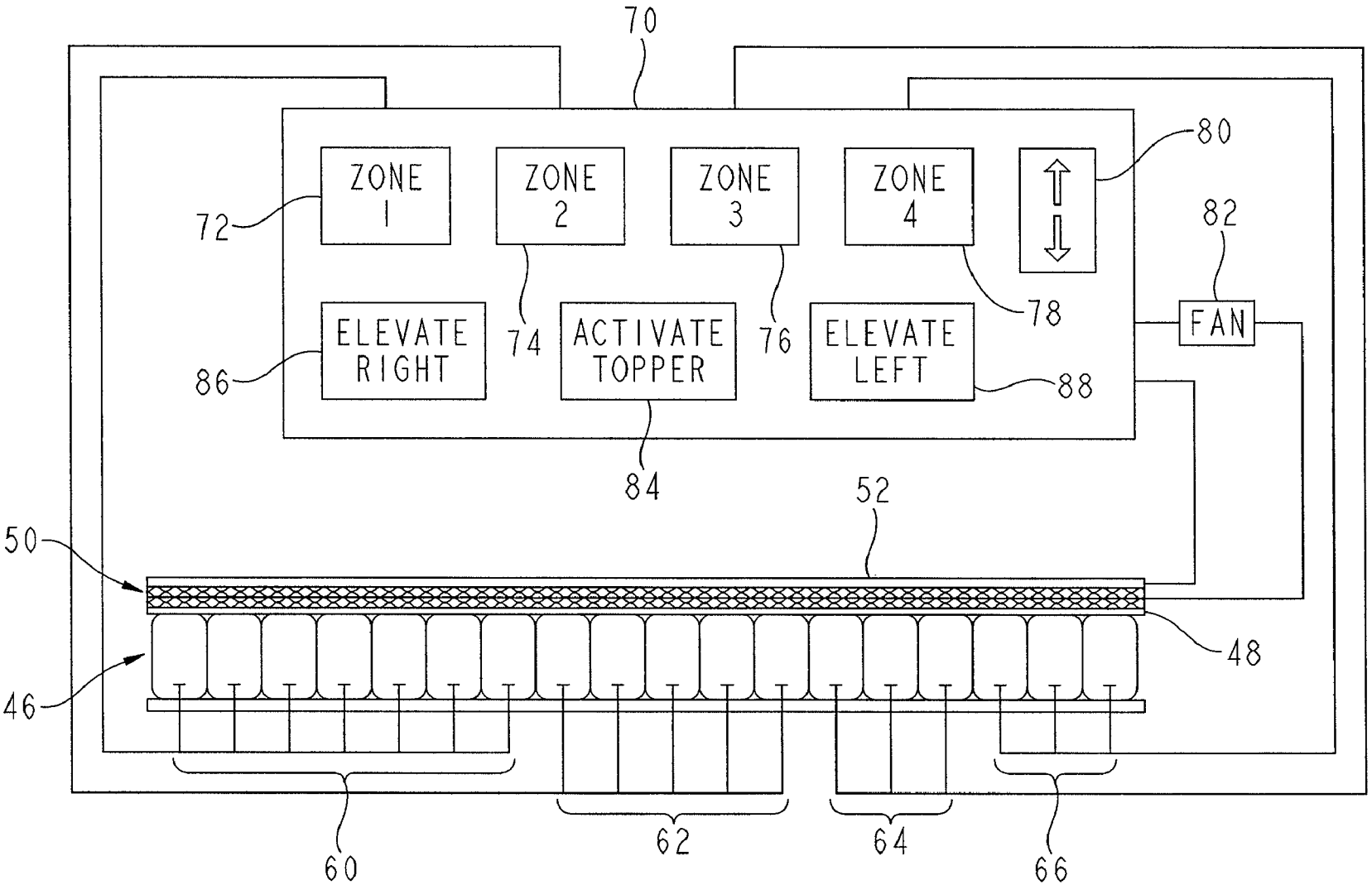
FIG. 2 illustrates a partial schematic view of a side view of the patient support coupled to a user interface.

FIG. 2 illustrates one embodiment of the bladders 46 configured as a zoned mattress. As illustrated, the zoned mattress 46 includes a first zone 60 configured to support the upper back and the shoulders/head of a patient. A second zone 62 is configured to support a lumbar region of the patient. A third zone 64 is configured to support a hip and/or knee region of a patient. A fourth zone 66 supports the heels of a patient. Each of the zones includes a pressure which is controlled by a controller 68, as illustrated in FIG. 1, and as is understood by those skilled in the art. The controller 68 either hangs on the footboard 28 or can sit upon a floor, adjacent to the bed 10, or can be incorporated into either the footboard, the headboard, or in one or more side rails.

The controller 68 includes a user interface 70, a portion of which is illustrated in FIG. 2. The user interface 70 can include manually depressible buttons or a touch screen. The user interface 70 includes a Zone 1 user input device 72 or button, a Zone 2 button, a Zone 3 button 76, and a Zone 4 button 78. Each of the zone buttons controls a respective zone as previously described for the zoned mattress 46. Each of the zone buttons are respectively used to control the air pressure within a respective zone coupled thereto. For instance, selection of the Zone 1 button 72 enables or activates a pressure up/down button 80. Once the zone 1 button 72 has been selected, the pressure up/down button 80 can be used by a caregiver to adjust the pressure either up or down within the selected zone 1. Upon selection of another zone, using for instance zone 2 button 74, the pressure up/down button 80 can now be used using adjust the pressure within the second zone 62. Likewise, selection of the remaining zone buttons enables the pressure up/down button 80 to control respective pressures within each of these zones. Other mechanisms for controlling pressure can also be used, such as automatic control of zones based on patient size and/or weight.

While the described and illustrated embodiment of FIG. 2 shows a zoned mattress having four controllable zones or sections, other numbers of controllable sections are within the scope of the present invention. For instance, the illustrated zone mattress of FIG. 2 includes seven bladders in Zone 1, five bladders in Zone 2, three bladders in Zone 3, and three bladders in Zone 4. In an alternative embodiment, a zoned mattress can be provided having the same number of bladders but having only three zones such that a first zone includes eight bladders, a second zone includes five bladders, and a third zone includes five bladders. It is also within the scope of the present invention to incorporate zoned mattresses having other numbers of individual inflatable bladders.

The air bladders 46 support the polyurethane barrier 48 which in turn supports the topper 50 which includes a three dimensional material. The topper 50 is coupled to a fan or blower 82 which can be incorporated into the controller 68 or elsewhere, such as within the mattress or within or upon the frame or the components thereof. To provide for moisture removal from a patient or to provide either cooling or heating (if the fan provides heated air), a caregiver or other user selects the desired state by pressing or touching the activate topper selector 84 which in turn causes the fan 82 to move air through the topper. The activate topper button 84 can include multiple modes such that the fan 82 can be controlled at different speeds to provide different air flows depending upon the requirements of a person supported by the mattress of the present invention.

Located above and supported by the topper 50 is the turning bladder 52 which can be controlled by an elevate right selector 86 and/or an elevate left selector 88. The elevate right selector 86 is used to raise the right side 54 of the turning bladder 52 such that the patient can be turned on a left side. The elevate left button 88 can be used to elevate the left side or second side 56 of the turning bladder 52 to place the patient on a right side. Additional details of the elevate right and elevate left positions are illustrated in FIG. 3 and FIG. 4 respectively.

Figure 3:
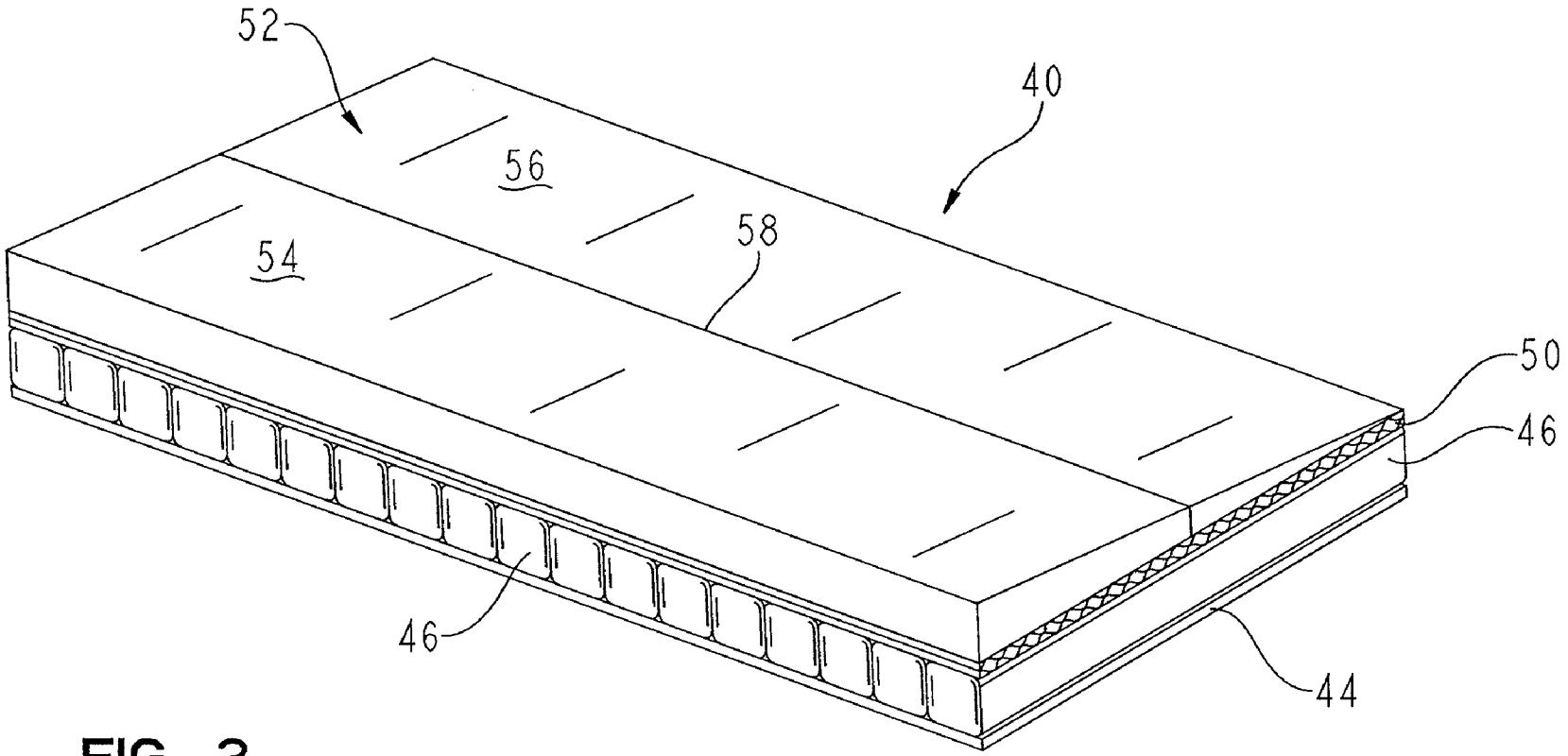
FIG. 3 illustrates a perspective schematic view of the patient support having an elevated left side portion and a collapsed or non-elevated right side portion for turning a patient.

FIG. 3 illustrates a perspective elevated view of the patient support surface 40. In this figure, the right side 54 is elevated upon activation by a caregiver using the elevate right button 86 of FIG. 2. An end view of the patient support surface 40 illustrates that the right side 54 and the left side 56 in this position generally define a wedge shape. While the polyurethane barrier 48 is not illustrated in FIG. 3, the polyurethane barrier 48 can be included if desired. It is not, however, necessary. As further illustrated in FIG. 4, the left side 56 has been inflated to elevate a portion of a patient such that the patient can be turned on the right side. In this instance, the right side 54 is not elevated with respect to the topper 50 such that an end view of the patient support surface 40 illustrates that the right side 54 and left side 56 embody a wedge shaped configuration.

Figure 5:
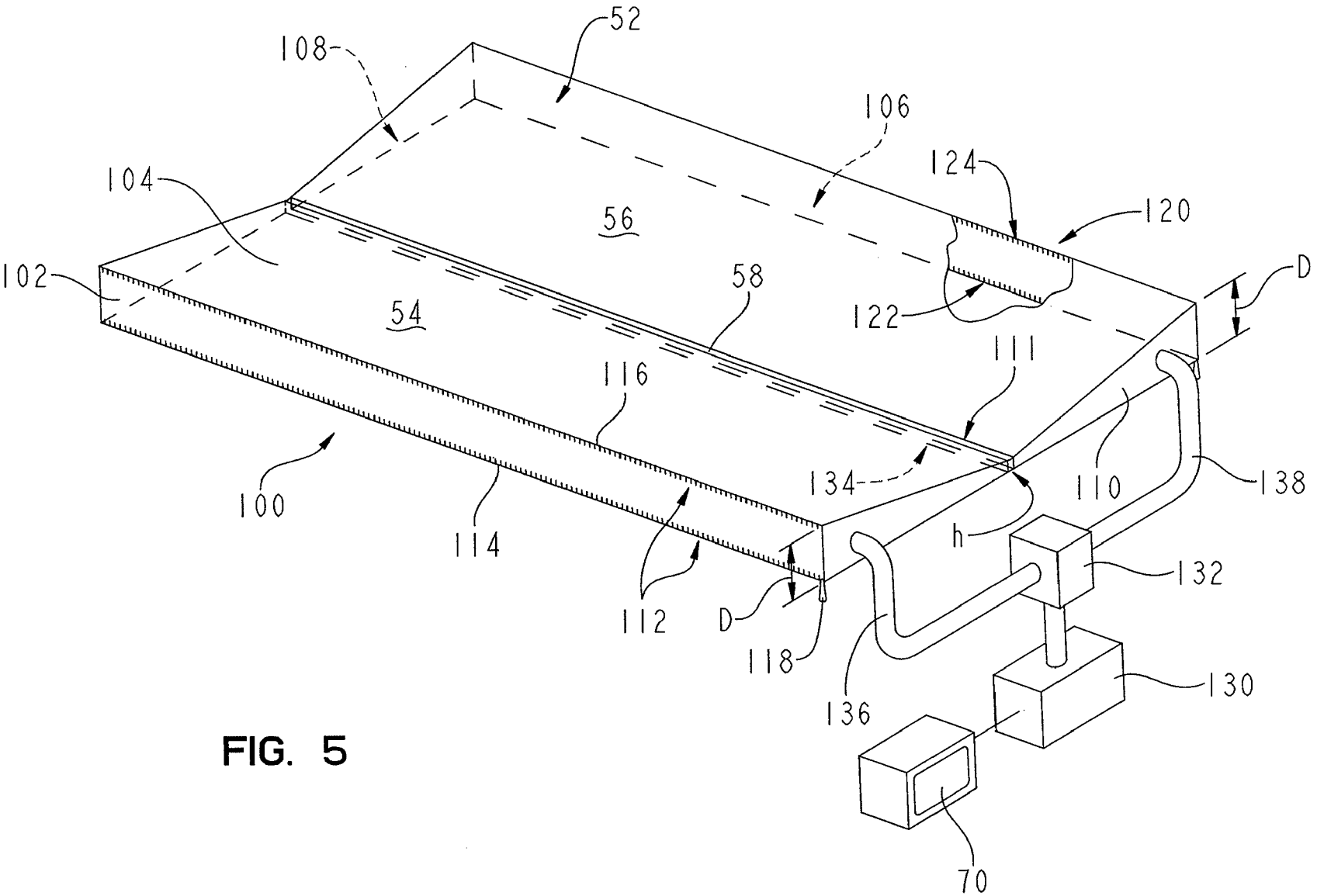
FIG. 5 illustrates a schematic perspective view of a turning bladder of the present invention coupled to a control system for selectively inflating either the left side portion, the right side portion of the turning bladder or both side portions.

To accomplish turning of a patient, including a bariatric patient, the turning bladder 52 as further illustrated in FIG. 5 incorporates a bladder of unitary construction including a base portion 100, a first side portion 102, a top portion 104, and a second side portion 106. The first side portion 102 and the second side portion 106 are coupled to the base portion 100 and to the top portion 104 to create a substantially air tight bladder defining a single air chamber. End portions 108 and 110 complete the enclosure the turning bladder 52 which comprise a single or unitary bladder having the center line 58. As illustrated, the center line 58 can include a tape 111 or other restraints to limit the expansion of the bladder 52 along the center line 58. On either side of the centerline 58, the first and the second side portions are defined and can include substantially the same amount of air when fully inflated. Each of the side portions includes a distance D, measured substantially vertically at an outside edge from the bottom portion to the top portion when inflated. The distance D is greater than a distance h at the center of the restraint 111. The central portion 111 of the restraint is made shorter than either of the side portions having the distance D.

Figure 4:
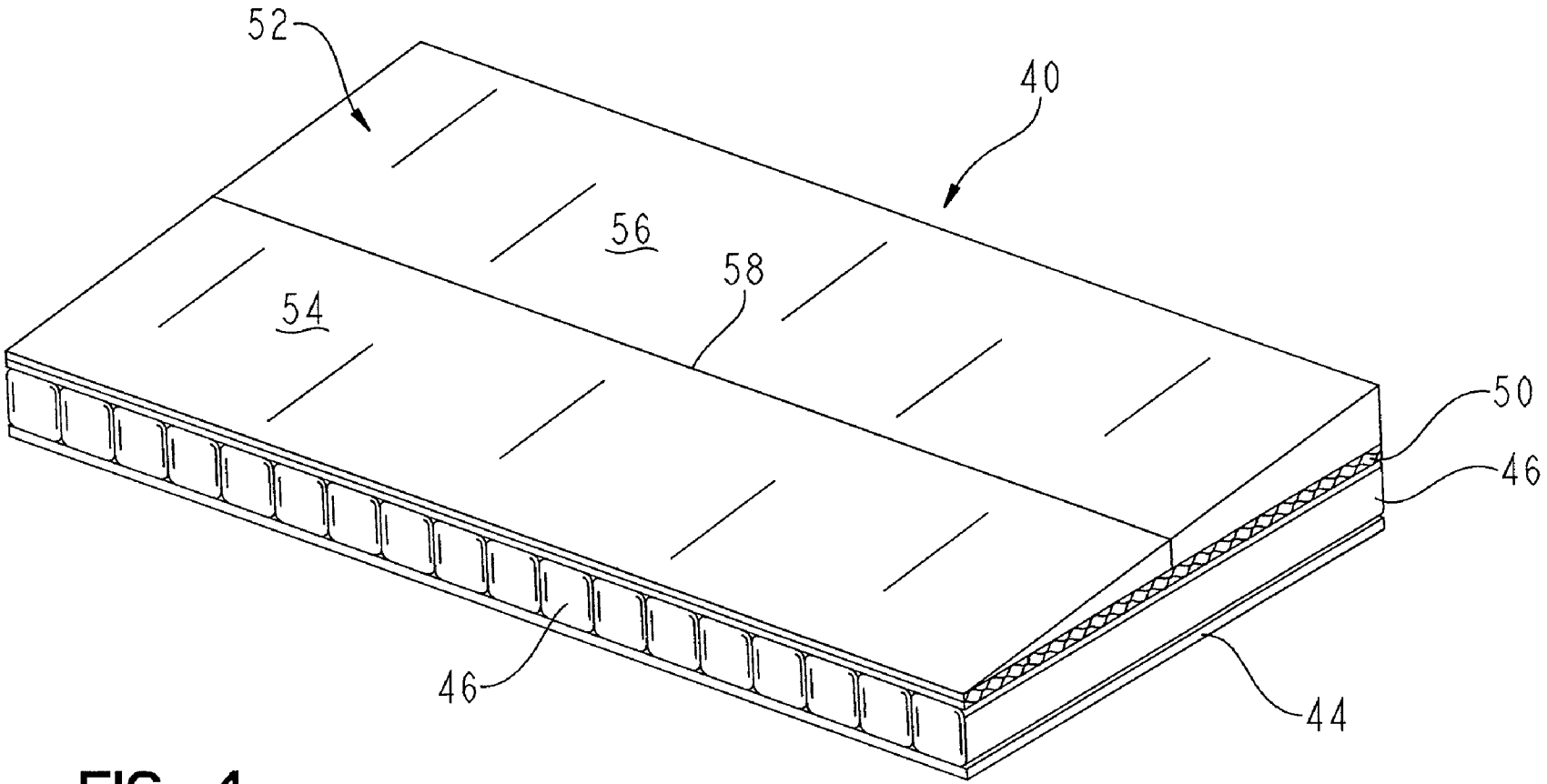
FIG. 4 illustrates a schematic view of a patient support having an elevated right side portion and a collapsed or non-elevated left side portion for turning a patient.

To provide the wedge shaped configurations of FIG. 3 and FIG. 4, the first side portion 102 includes a fastener or coupler 112. In the illustration of FIG. 5, the fastener 112 includes a zipper having a first side 114 and a second side 116. A zipper tab 118 can be used to couple the first side 114 to the second side 116 thereby reducing the height of the first side portion 102 to configure the turning bladder of FIG. 4. A second fastener 120 is coupled to the second side portion 106 and includes a first side 122 and a second side 124 substantially similar to the first fastener 112. When the second fastener 120 is closed or coupled together and the first fastener 112 is in the uncoupled or open position, the wedge shaped turning bladder configuration of FIG. 3 can be provided.

During operation of the turning bladder, the caregiver or user selects at the control panel 70 one of the elevate right 86 or elevate left 88 buttons as previously described. Prior to selection of these buttons, however, the caregiver can either zip or unzip the fastener 112 or 120 to create an elevate right bladder or an elevate left bladder as desired. For instance, if the caregiver desires to create an elevate right bladder, the coupler 112 is opened such that the first side portion can be fully extended and the second fastener 120 is closed to maintain the second side portion at its minimum height in a closed condition. Once the zippers have been appropriately located, the elevate right button 86 is selected which in turn causes an inflation device, including a blower/air supply 130, to provide air to the first side 54 under control of a valve 132 which has been appropriately positioned. Control of valves by controllers are known by those skilled in the art. Because the restraint 111 limits the expansion of the air bladder along the center line 58 and the zipper 120 has been closed, a certain amount of forced air will pass through the aperture 134 created by the restraint 111. Consequently, depending on the selection of which fasteners to open or to close, a wedge shaped configured turning bladder is provided for turning a patient. It is also within the scope of the present invention to include a blower and a single air tube or hose coupled to a central portion of the turning bladder 52 since air can flow through the aperture 134 to either side. Coupling a first tube or hose 136 and a second tube or hose 138 from the valve 132 to the bladder 52 can provide for faster filling or evacuation of the bladders than may be available with a single hose.

Figure 6:
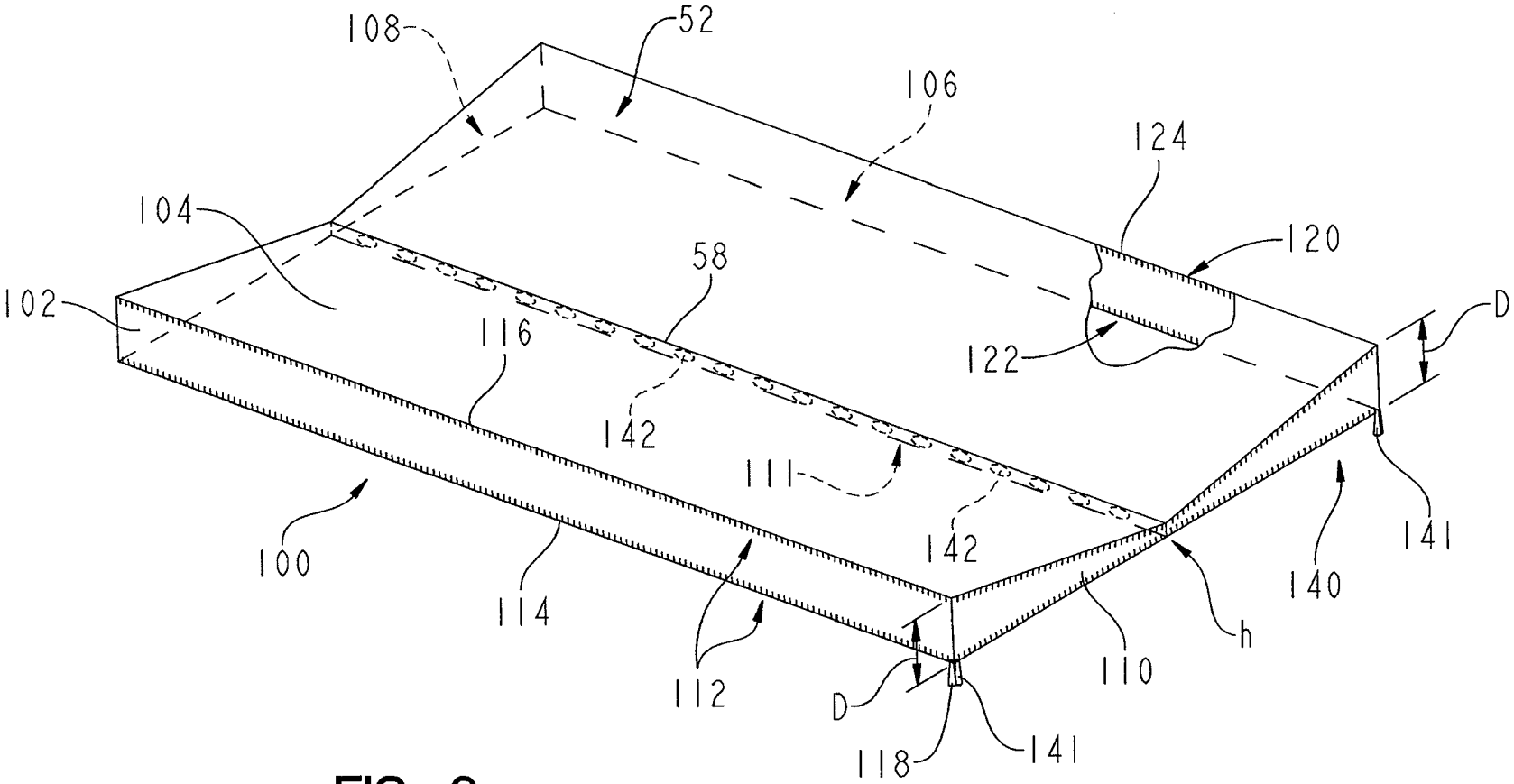
FIG. 6 illustrates another embodiment of the turning bladder of FIG. 5.

As further illustrated in FIG. 6 (without the inflation device), the turning bladder 52 can include a coupler 140 at the end portion 110 which can be zipped from either of the sides 102 and 106 to the center to close an end portion appropriately for right or left elevation. Fastening of coupler 140 closes one of the end portions extending from a lateral side portion to the center line to provide the desired wedge shaped configuration. The head end at the end portion 108 is similarly appropriately configured as the foot end to include a coupler (not shown).

The coupler 140 includes tabs 141 for closing or opening the coupler 140 as desired to create a turning bladder. To create a turning bladder, the coupler at the head end and at the foot end of the mattress are closed from one of the sides to the centerline. The remaining portion of the coupler is left open during inflation to create the wedge shaped configurations of either FIG. 3 or 4. A top and bottom longitudinal edge are held together when the zipper is closed from one of the sides to the center.

An alternative embodiment of the center line restraint 111 can include a divider including a plurality of holes 142 (see FIG. 6), such as a screening material (not shown). A perforated or apertured flexible material such as plastic can also be used. The apertures provide for the passage of air from one side of the turning bladder to the other side of the turning bladder for inflation thereof. The divider can be coupled respectively to the top and bottom of the bladder to maintain the distance h.

Figure 7:
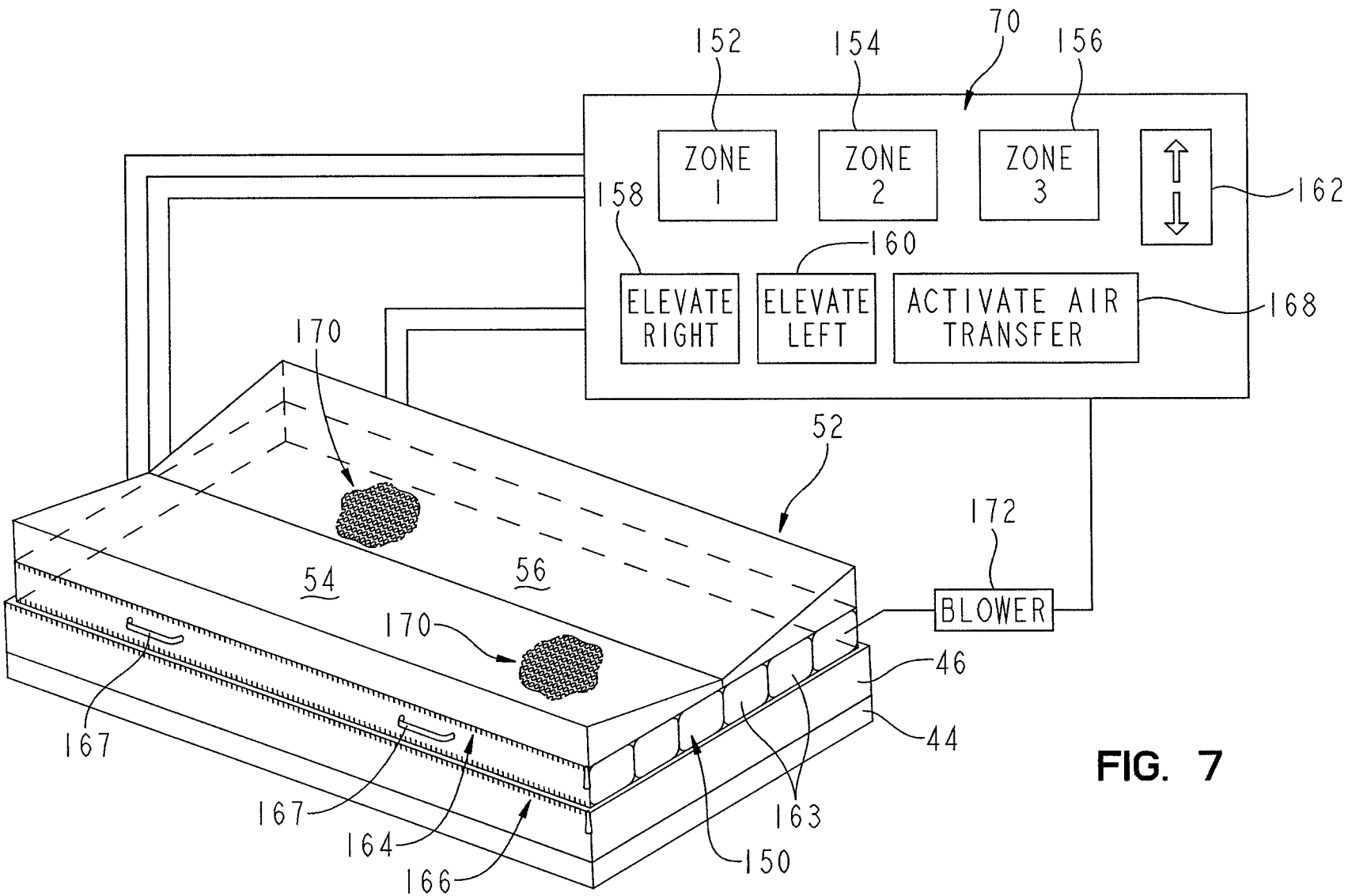
FIG. 7 illustrates a schematic perspective view of the patient support of FIG. 1, further including a lateral transfer apparatus and a user interface of the present invention.

FIG. 7 illustrates an alternative embodiment of the present invention including the turning bladder 52, the air bladder 46, and the foam base 44. In this alternative embodiment, a lateral transfer chamber 150 (shown inflated) is disposed between the turning bladder 52 and the air bladder 46. The lateral transfer chamber 150 can be used to move a patient from one frame or patient support to another frame or patient support. As previously described, this embodiment includes the user interface 70 which includes a button or user interface selectors 152, 154 and 156 for selecting and pressurizing and adjusting the pressure of the pressures within individual zones 1, 2 and 3 respectively as previously described. In addition, this particular user interface includes an elevate right selector 158 and an elevate left selector 160. Once either of the elevate selectors 158, 160 have been selected, an air pressure up down button 162 can be selected to adjust the pressure at each of the zones.

The lateral transfer chamber 150 includes a plurality of longitudinally oriented air bladders 163. While six individual air bladders are described, other numbers of air bladders may also be included. The lateral transfer chamber further includes a first coupler 164 and a second coupler 166. The first coupler 164 can couple the lateral transfer chamber 150 to the turning bladder 52 and the second coupler 166 can couple the lateral transfer chamber 150 to the air bladders 46. The opposite side can include similar couplers. To move a patient from one frame or support deck to another frame or support deck, the coupler 166 and the opposite side coupler of the support surface are uncoupled. The combination of the turning bladder 52 and the lateral transfer chamber 150 can then be pulled to another frame by a caregiver using handles 167.

To move a patient, the caregiver presses an activate air transfer button 168 which hyper-inflates the lateral transfer chamber 150. The chamber 150 includes a plurality of holes 170 on the bottom surface thereof. Upon selection of the activate air transfer button 168, an air blower 172 hyper-inflates the lateral transfer chamber 150 such that the chamber 150 and turning bladder 52 are supported by a cushion of air created between the bottom of the transfer chamber 150 and the coverlet surrounding the air bladders 46. While it is possible to transfer a patient having both the first side 54 and the second side 56 of the turning bladder 52 in a deflated state, it is preferred that the first side 54 and second side 56 have each of the respective fasteners (not shown) uncoupled, such that the first side 54 and second side 56 provide a concave or trough-like feature therebetween (see FIG. 5) for cradling or holding the patient when the patient is moved from one frame to another.

Further details of an air transfer device can be found in U.S. Pat. Re. 35,299 which is incorporated by reference herein in its entirety.

Figure 8:
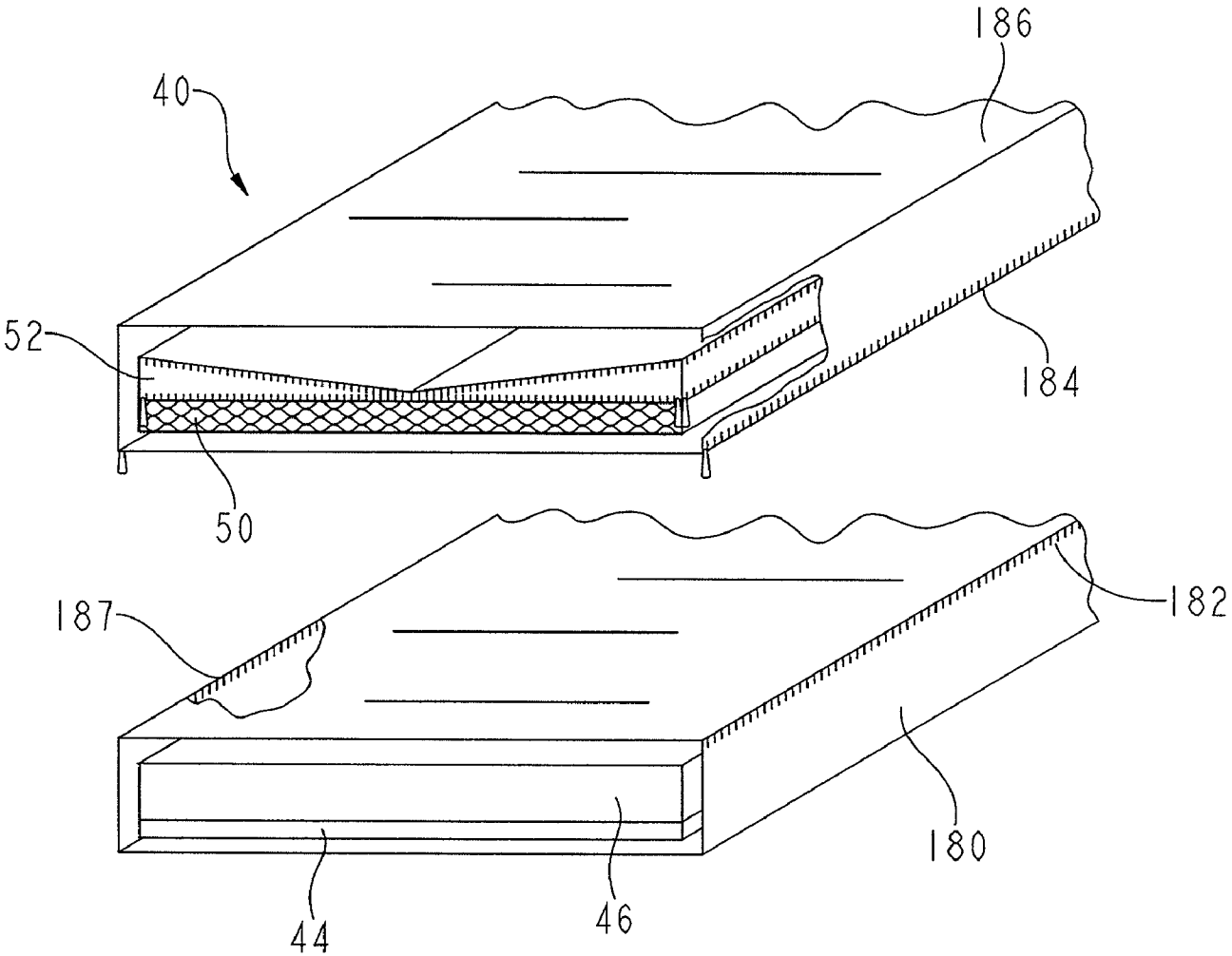
FIG. 8 illustrates a partial schematic perspective view of an alternative embodiment of the patient support.

FIG. 8 illustrates a schematic perspective view of the foam layer 44, the air bladder layer 46, the topper layer 50 and the turning bladder layer 52. The air bladder layer 46 and foam layer 44 are covered by a coverlet 180, illustrated open ended, but which includes closed ends to completely surround or encapsulate the foam layer and air bladder layer. The coverlet 180 includes a coupler 182 which mates with a coupler 184 included in a coverlet 186 used to surround or encapsulate the topper 50 and the air bladder 52. The opposite side includes a coupler 187. While both coverlets 180 and 186 are shown to have an open end for purposes of illustration, the coverlets are complete enclosures for enclosing the components held therein. By including the couplers, the lateral transfer chamber can be coupled between the coverlets with a corresponding zipper or can be left out such that the coverlet 180 can be directly coupled to the coverlet 186. Consequently, by using mateable coverlets, the described embodiments can be configured to mate with a lateral transfer chamber if desired.

Although the invention has been described in detail with reference to certain preferred embodiments, variations and modifications exist within the scope and spirit of the present invention. For instance, while the couplers have been generally described as zippers, other couplers such as hook and loop fasteners may also be provided. Accordingly, it is intended to embrace all such alternatives, modifications and variations that fall within the sprint and broad scope of the appended claims.

What is claimed is:

1. A turning bladder to turn a bariatric patient, comprising:

a base portion;

a top portion positioned above the base portion;

a first side portion coupled to the base portion and to the top portion;

a second side portion coupled to the base portion and to the top portion;

a first fastener, coupled to the first side portion, the first fastener including a closed position and an open position, wherein the closed position holds the first side portion in a closed condition and the open position releases the first side portion to an open condition having a first height; and a restraint coupled to the top portion and to the base portion and disposed between the first side portion and the second side portion, the restraint including a dimension to control a distance between the top portion and the bottom portion, wherein the restraint has a center height configured to be less than the first height of the first side portion, and the second side portion has a second height configured to be about equal to the first height of the first side portion, and the center height of the restraint is less than the first height and the second height.

2. The turning bladder of claim 1, wherein the first side portion, the top portion, and the base portion define a first chamber defining a first volume to hold a fluid.

3. The turning bladder of claim 2, wherein the second side portion, the top portion, and the base portion define a second chamber defining a second volume to hold a fluid.

4. The turning bladder of claim 3, wherein the restraint is disposed substantially along a longitudinal centerline of the turning bladder and provides for air flow from the first chamber to the second chamber.

5. A patient support to support a bariatric patient, comprising:

a foam member;

at least one air bladder, supported by the foam member; and a turning bladder supported by the at least one air bladder and adapted to be inflated with a fluid, the turning bladder including a base portion, a top portion, a first side portion and a second side portion each coupled to the top portion and to the base portion, and a restraint coupled to the top portion and to the base portion and disposed between the first side portion and the second side portion, the restraint including a dimension to restrict a distance between the top portion and the bottom portion, wherein the first side portion is configured to have a first height, the second side portion is configured to have a second height about equal to the first height of the first side portion, and the restraint is configured to have a center height less than the first height and the second height.

6. The patient support of claim 5, wherein the restraint comprises a material including at least one aperture, the at least one aperture providing for the transfer of the fluid from one side of the restraint to the other side of the restraint.

7. The patient support of claim 6, wherein the restraint comprises a material including a plurality of apertures.

8. The patient support of claim 7, wherein the material including a plurality of apertures includes a perforated fabric.

9. The patient support of claim 5, further comprising a first fastener, coupled to the first side portion, the first fastener including a closed position and an open position, wherein the closed position holds the first side portion in a closed condition and the open position releases the first side portion to an open condition having a first height.

10. The patient support of claim 9, wherein the first side portion includes a top longitudinal edge disposed substantially adjacent to the top portion and a bottom longitudinal edge disposed substantially adjacent the base portion.

11. The patient support of claim 9, wherein the first fastener includes a first coupler disposed at the top longitudinal edge and a second coupler disposed at the bottom longitudinal edge, the first and second coupler including mating portions to hold the first coupler to the second coupler.

12. The patient support of claim 11, further comprising a lateral transfer chamber disposed between the turning bladder and the at least one air bladder.

13. The patient support of claim 12, further comprising a three-dimensional fiber network supported by the at least one air bladder.

14. The patient support of claim 13, wherein the foam member comprises a unitary foam member having a width and a length substantially similar to the width and length of the air mattress.

15. A bariatric patient support to support a bariatric patient comprising:

a frame adapted to support the bariatric patient;

a deck, coupled to the frame;

a mattress, supported by the deck; and a bladder, supported by the mattress, to turn the bariatric patient, the bladder including a base portion, a first side portion coupled to the base portion, a second side portion coupled to the base portion, a central portion disposed between the first side portion and the second side portion, the central portion including a center height less than the first height of the first portion, a first fastener, coupled to the first side portion, the first fastener including a closed position and an open position, wherein the closed position holds the first side portion in a closed condition and the open position releases the first side portion to an open condition having a first height, and a second fastener coupled to the second side portion, the second fastener including a closed position and open position, wherein the closed position holds the second side portion in a closed condition and the open position releases the second side portion to an open condition having a second height and the first height is substantially equal to the second height.

16. The bariatric patient support of claim 15, wherein the first fastener comprises a zipper.

* * * * *